US008829381B2

(12) United States Patent
Wehr

(10) Patent No.: US 8,829,381 B2
(45) Date of Patent: Sep. 9, 2014

(54) HIGH INTERRUPTING RATING MOLDED CASE CIRCUIT BREAKER

(75) Inventor: Eugene Wehr, Cedar Rapids, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 268 days.

(21) Appl. No.: 13/526,154

(22) Filed: Jun. 18, 2012

(65) Prior Publication Data

US 2013/0334174 A1 Dec. 19, 2013

(51) Int. Cl.
*H01H 33/04* (2006.01)

(52) U.S. Cl.
USPC ..... 218/157; 335/132

(58) Field of Classification Search
USPC ..... 218/148–151, 157; 335/132
See application file for complete search history.

(56) References Cited

U.S. PATENT DOCUMENTS

| | | | | |
|---|---|---|---|---|
| 4,910,485 | A | 3/1990 | Bolongeat-Mobleu et al. | |
| 6,005,207 | A * | 12/1999 | DiMarco et al. | 200/303 |
| 6,198,063 | B1 * | 3/2001 | Kramer | 218/157 |
| 8,519,287 | B2 * | 8/2013 | Raabe et al. | 200/306 |
| 2004/0227602 | A1 | 11/2004 | Ciarcia et al. | |
| 2007/0095793 | A1 * | 5/2007 | Zindler | 218/148 |
| 2008/0002339 | A1 * | 1/2008 | Dixon et al. | 361/673 |
| 2008/0277382 | A1 * | 11/2008 | Chen et al. | 218/151 |
| 2011/0216480 | A1 | 9/2011 | Siebels et al. | |

OTHER PUBLICATIONS

International Search Report and Written Opinion for International Application No. PCT/US2013/044719 mailed Sep. 25, 2013.

* cited by examiner

*Primary Examiner* — Truc Nguyen
(74) *Attorney, Agent, or Firm* — Locke Lord LLP

(57) ABSTRACT

A circuit breaker having an increased interrupting rating without increasing the size of the circuit breaker while maintaining full compliance with UL and IEC standards. An adhesive is applied to a bottom surface near the exhaust outlets of interrupters. The interrupter housing is formed by joining two pieces, and the adhesive is applied across both pieces. The adhesive adheres to a bottom interior surface of a base of the circuit breaker, anchoring the interrupter assembly to the base. The adhesive prevents the two pieces of the interrupter housing from separating during an interruption event, and prevents the interrupter assembly from being lifted away from the base during the interruption event. The adhesive can act as a barrier to prevent interruption gas and pollution that do not escape out of the exhaust ports of the base from entering between the bottom of the interrupter assembly and the interior of the base.

20 Claims, 7 Drawing Sheets

HIGH INTERRUPTING RATING MOLDED CASE CIRCUIT BREAKER

TECHNICAL FIELD

The present disclosure relates generally to electrical distribution equipment and, more particularly, to a high interrupting rating circuit breaker.

BACKGROUND

Circuit breakers are designed to have an interrupting rating capacity (also called a service breaking capacity or $I_{CS}$) that specifies a maximum theoretical current that the circuit breaker is rated to handle in a repeatable and safe manner that does not cause damage to the physical or operational integrity of the circuit breaker. For example, a circuit breaker can have a service breaking capacity (or interrupting rating) of 20 kA at a maximum voltage of 690V. But this rating capacity is not adequate for installations with high current availability, such as marine, buildings, or information technology installations, which can have a current availability up to 100 kA at a maximum voltage of 690V. For these installations, a single 20 kA circuit breaker cannot be used without violating applicable standards. However, in some installations, for example in marine installations, space constraints limit the maximum physical dimensions of a circuit breaker that can be installed. If the current rating is increased from 20 kA to 100 kA, the circuit breaker would still need to meet or exceed stringent standards, such as promulgated by IEC (International Electrotechnical Commission) and UL (Underwriters Laboratories), concerning mechanical strength, dielectric withstand, and temperature rise performance requirements. The conventional way to support a higher interrupting rating is to increase the size of the circuit breaker components to handle the higher current levels, which in turn increases the overall size of the circuit breaker. But increasing the overall size of the circuit breaker is undesirable in space-constrained installations. What is needed is an improved circuit breaker design that allows the circuit breaker to perform interruption at a higher interrupting rating while complying with all relevant standards without increasing the physical dimensions or weight of an otherwise lower-rated circuit breaker.

SUMMARY

An improved circuit breaker is disclosed that performs interruption at higher interrupting ratings while fully complying with standards, such as the IEC and UL standards. In some implementations, the circuit breaker uses a modular construction with a double-break design, such as described in U.S. Pat. No. 4,910,485, which is capable of developing arc voltage quickly to achieve current limitation and fast interruption. Extending the default interruption capability from 690V/20 kA to 690V/100 kA without changing the overall physical dimensions of the circuit breaker size raises structural and dielectric challenges that are overcome by aspects of the present disclosure. Some of the solutions to improve the structural strength of the circuit breaker to achieve the higher interruption rating include any one or more of the following: (1) the use of an adhesive bond between the interrupters and the circuit breaker housing; (2) forming part of the interrupter housing using compression molded thermoset sheet molding compound (SMC); or (3) using high-strength bolts and nuts with a controlled bolt preload during the assembly process. These structural improvements reduce the separation between the interrupter sides during a short-circuit fault and limit the propagation of short circuit byproducts (e.g., molten particles) that contribute to the degradation of the dielectric performance of the circuit breaker following a short circuit event.

When the interrupter housing is made of two pieces (for example, case halves) joined together to form the housing, the adhesive is applied to a bottom surface of the housing across both pieces near the exhaust outlet of the interrupter. Gas and pollution produced during an interruption following an electrical fault, such as a short-circuit, exit through the exhaust outlet. Normally, the gas and pollution should exit the exhaust outlet and be routed through exhaust ports in the base of the circuit breaker and finally exhausted out of and away from the circuit breaker through the exhaust ports. However, the pressure during the microseconds that a fault lasts is very sudden and intense, allowing some of the gas and pollution to escape into a gap between the bottom of the interrupter housing and the interior surface of the base of the circuit breaker. When this happens, the pressure forces produced by these wayward gasses and pollution cause the interrupter housing to lift away from the base of the circuit breaker and cause the case halves of the interrupter housing to be forced apart from one another. The adhesive opposes the tendency of the interrupter housing to lift away from the housing and to separate along its lengthwise seams at least along the bottom part where the adhesive is applied. But moreover, applying an adhesive at strategic locations on the bottom of the interrupter housing across both pieces of the interrupter housing further allows the adhesive, once cured, to act as a barrier to gas and pollution that would otherwise find their way underneath the interrupter housing. Thus, all or nearly all of the gas and pollution released during an electrical fault will find its way through the exhaust outlet and be safely exhausted out of the exhaust ports.

The foregoing and additional aspects of the present disclosure will be apparent to those of ordinary skill in the art in view of the detailed description of various aspects, which are made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

DETAILED DESCRIPTION

Although the subject matter will be described in connection with certain aspects, it will be understood that the subject matter described herein is not limited to those particular aspects. On the contrary, the inventive subject matter is intended to cover all alternatives, modifications, and equivalent arrangements as may be included within the spirit and scope as defined by the appended claims.

Figure 1:
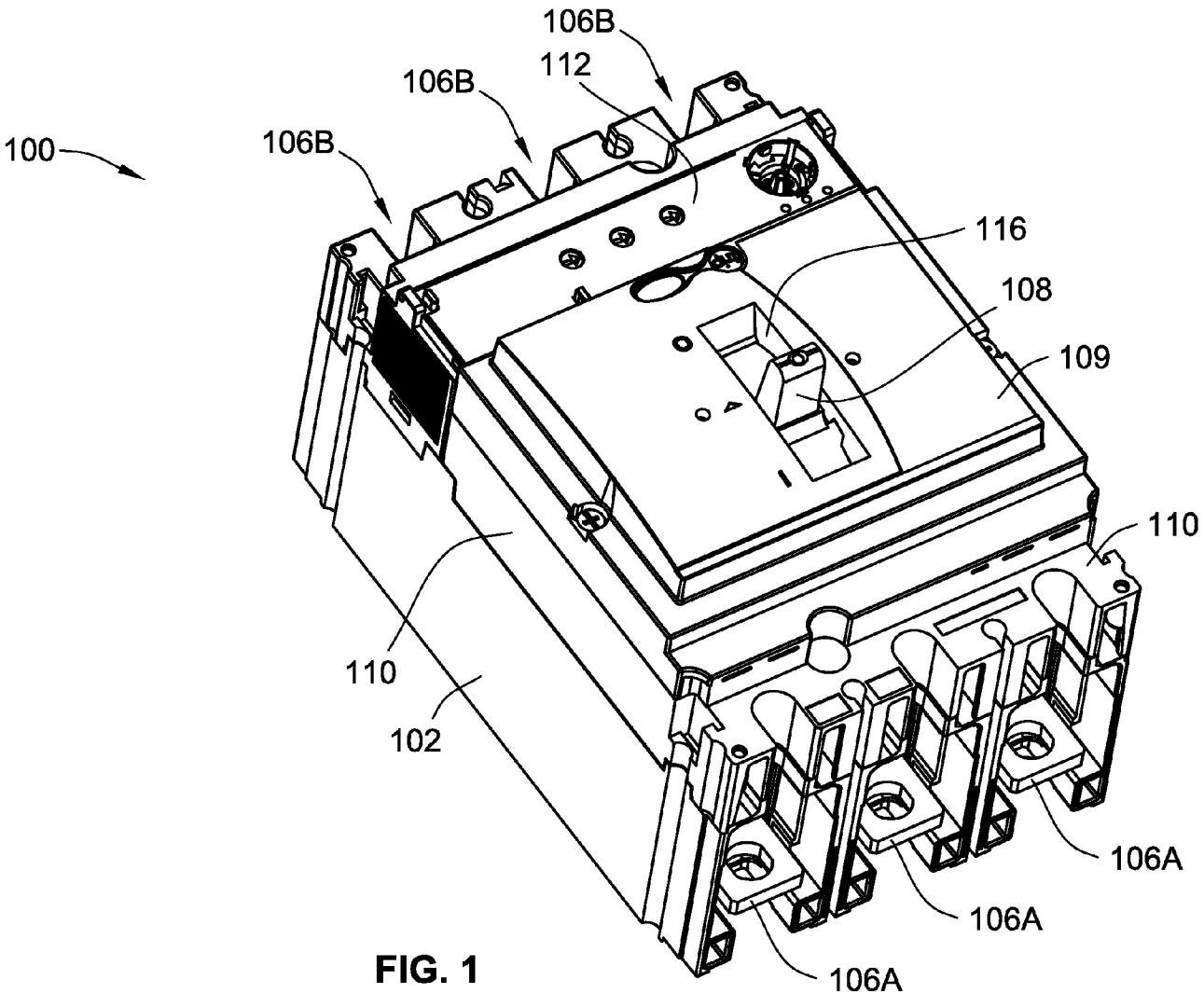
FIG. 1 illustrates a perspective view of a circuit breaker according to one or more aspects of the present disclosure.

Referring to FIG. 1, an electro-mechanical device such as a circuit breaker 100, here of the molded-case circuit breaker (MCCB) type, will be described in general. The circuit breaker 100 generally includes a housing or base 102 having an ampoule assembly 200 therein (shown in FIG. 2) in which the ampoule assembly 200 includes one or more line terminals 106A and one or more load terminals 106B. As used herein, the terms ampoule assembly and interrupter assembly are used interchangeably. The housing or base 102, as shown in FIG. 1, is designed to at least partially house the terminals 106A, 106B along a bottom surface 402 (seen in FIG. 4A) of the circuit breaker 100. The housing or base 102 can be formed by molding to form part of a molded case of the circuit breaker 100. A mechanism cover 110 opposite the bottom surface fits on top of the base 102 along with a trip unit 112 such that the mechanism cover 110 and trip unit 112 at least partially house the terminals 106A, 106B along a top surface 109 of the circuit breaker 100.

Figure 2:
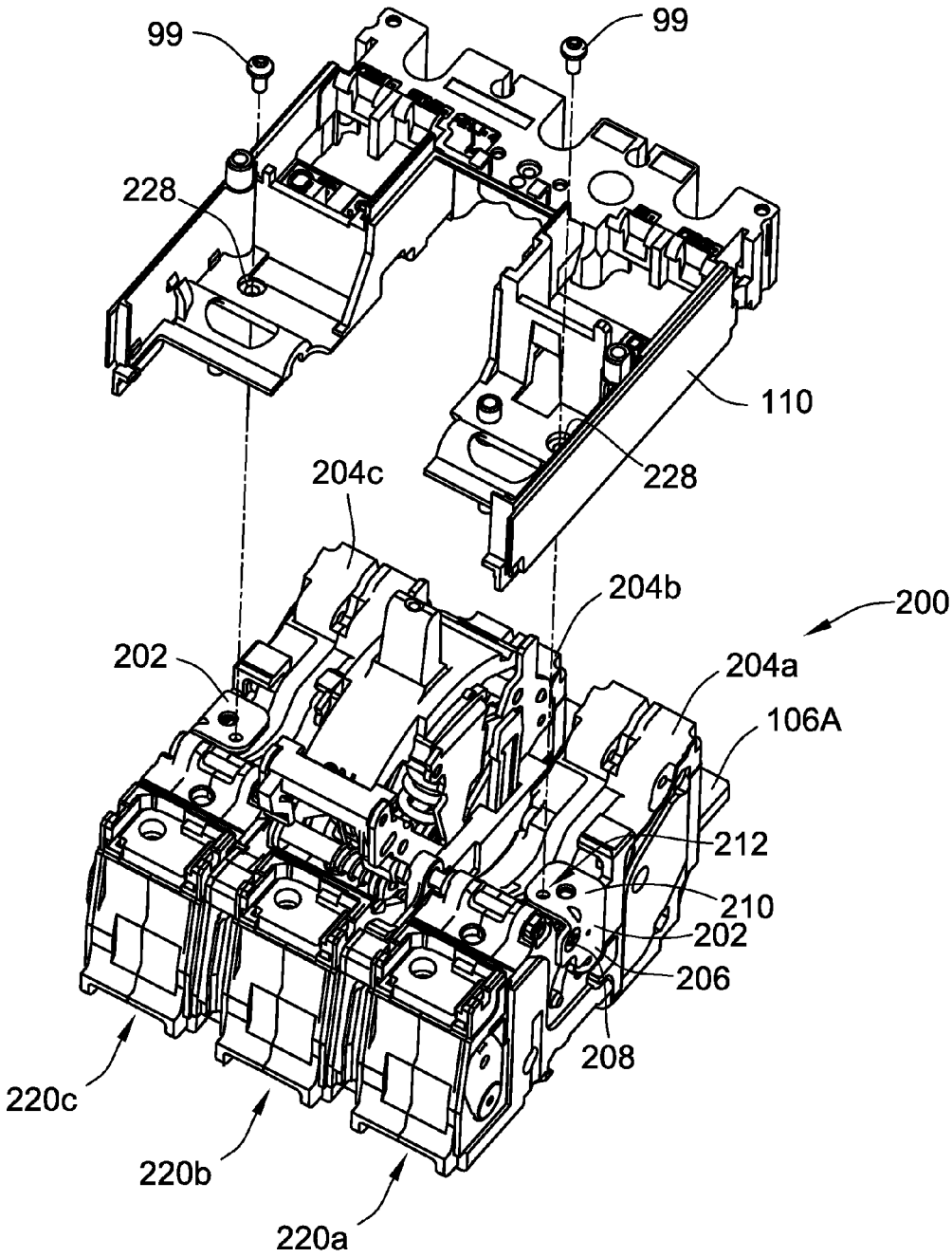
FIG. 2 illustrates an exploded view of an interrupter or ampoule assembly and a mechanism cover of the circuit breaker shown in FIG. 1.

As shown in FIG. 1, the handle 108 is coupled to the ampoule assembly 200 shown in FIG. 2. A trim cover 114 fits on top of the mechanism cover 110, so that the handle 108 protrudes through a handle aperture 116 in the trim cover 114. Fasteners, such as screws 99, rivets, bolts, or the like secure the trim cover 114 to the mechanism cover 110.

The handle 108 is operated to manually reset the circuit breaker 100. The handle 108 is also adapted to serve as a visual indication of one of several positions of the circuit breaker 100. When the circuit breaker 100 is in the ON position, current flows unrestricted through the circuit breaker 100 between the line terminals 106A and the load terminals 106B, and to the electrical load(s) or circuit that the circuit breaker is designed to protect. Another position of the circuit breaker 100 is a TRIPPED position in which the flow of current through the circuit breaker 100, and consequently through the protected loads or circuits, is interrupted.

Electrical current enters the circuit breaker 100 through the line terminal 106A and exits the circuit breaker 100 through the load terminal 106B. A conventional switching mechanism (not shown) within the circuit breaker 100 is activated when the current through the circuit breaker 100 exceeds the rated current by a predetermined threshold over a specified period of time. The switching mechanism causes the handle 108 to move from the ON position to the TRIPPED position, thereby interrupting the flow of current through the circuit breaker 100.

As stated, during the actuation of the circuit breaker 100 from the ON position to the TRIPPED position, interruption gases become present within the circuit breaker 100. The gases attempt to exit the circuit breaker 100 from within, and considering that the pressure from the interruption gases is substantial, the base 102, the mechanism cover 110 and the trim cover 116 must be sufficiently supported and mounted to one another to prevent the gases from damaging them as well as the circuit breaker. Additionally, the base 102, the mechanism cover 110 and the trim cover 116 must be sufficiently supported and mounted to one another to prevent the gases from escaping from within the circuit breaker 100.

FIG. 2 illustrates an exploded view of a portion of an interrupter assembly 200 of the circuit breaker 100 shown in FIG. 1. The interrupter assembly 200 includes a first interrupter 204*a*, a second interrupter 204*b*, and a third interrupter 204*c*, each carrying a different phase of electrical current. A fourth interrupter is used in a four-pole circuit breaker to protect the neutral wire. Inside each of the interrupters 204*a, b,c* is a conventional set of contacts, such as the "double-break" stationary and rotary contacts like those shown and described in U.S. Pat. No. 4,910,485. A first electrical contact 320 (e.g., a rotary contact as shown in FIG. 3C) is movable (e.g., rotatable) relative to a second electrical contact 322 (e.g., one or more stationary contacts shown in FIG. 3C) such that physical engagement of the first electrical contact 320 with the second electrical contact 322 permits electrical current to flow through the interrupter 204*a,b,c* from the line terminal 106A to a load terminal 330, and such that physical separation of the first electrical contact 320 relative to the second electrical contact 322 (shown separated in FIG. 3C) prevents the electrical current from flowing through the interrupter 204*a,b,c* as known in the art. Each interrupter described herein is identical, so for ease of discussion and illustration, sometimes only one interrupter will be described, but the description of one interrupter applies equally to the other two.

Optional cover clips 202 can be further secured between the interrupters 204*a,c* and the mechanism cover 110, to the circuit breaker 100 during an interruption event, strained by high pressure interruption gases and pollution. The cover clips 202 couple to the respective outer interrupters 204*a,c*. Each of the cover clips 202 is bent to form an L-shape where a first portion 206 is fastened to the interrupter assembly 200 by a fastener 208 and a second portion 210 that is bent at an orthogonal angle relative to the first portion 206 includes an aperture 212 for receiving a screw 99 that secures the cover clip 202 to the mechanism cover 110 as shown in FIG. 2. Other example cover clips or supports suitable for securing the interrupter assembly 200 to the mechanism cover 110 are described and shown in U.S. Pat. No. 8,134,092, entitled "Circuit Breaker Cover Attachment," issued Mar. 13, 2012. The cover clips 202 make the the mechanism cover 110 highly resistant to bending or lifting during short circuit interruptions.

After the mechanism cover 110 is coupled to the base 102, the trim cover 114 is placed on top of the mechanism cover 110 to further assemble the circuit breaker 100. The cover clips 202 provide added support and mechanical stability to allow the circuit breaker 100 to withstand forces from interruption gases within the circuit breaker 100. It should also be noted that although only two cover clips 202 are shown and described, more than two or only one cover clips can be incorporated in the circuit breaker 100.

Figure 4A:
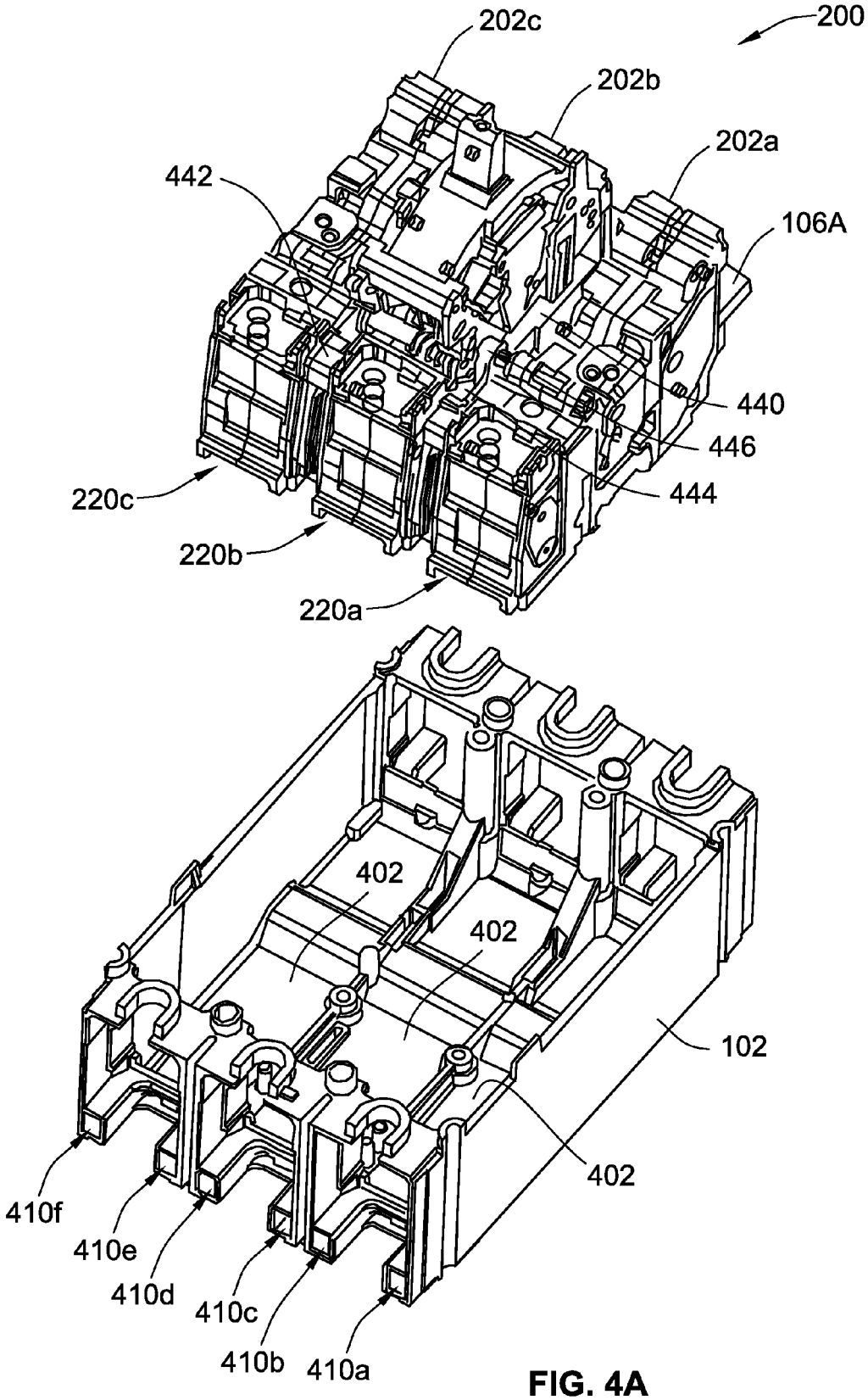
FIG. 4A is a top perspective, exploded view of the interrupter assembly shown in FIG. 2 and an interior bottom surface of the housing or base of the circuit breaker shown in FIG. 1.

In FIG. 2, it can also be seen that each of the interrupters 204*a,b,c* includes a corresponding exhaust outlet 220*a,b,c*. These exhaust outlets 220*a,b,c* provide a path for interruption gasses and pollution produced in response to an electrical fault, such as a short-circuit, to escape out of the interrupter 202*a,b,c*. As can be seen in FIG. 4A, described more fully below, when the interrupter assembly 200 is installed into the base 102 of the circuit breaker 100, the exhaust outlets 220*a, b,c* align with corresponding exhaust ports (collectively numbered 410), to further direct the interruption gasses and pollution away from the circuit breaker 100.

The interrupter assembly 200 includes a spacer 442 (seen in FIGS. 4A and 4B) and a pneumatic trip 440 that has a piston trip lever 444 (shown in FIG. 4A) that operates on a latching mechanism 446 as is known in the art. The piston trip lever 444 conventionally is moved by gas pressure emanating from within one of the interrupters 202*a,b,c* during an electrical fault, and it strikes the latching mechanism 446, a known sequence of mechanical actions ensue that cause the circuit breaker 100 to trip. The pneumatic trip 440 is attached between the first interrupter 202*a* and the second interrupter 202*b*, and the spacer 442 is attached between the second interrupter 202*b* and the third interrupter 202*c*, such that the entire interrupter assembly 200 can be handled as a unitary device. The pneumatic trip 440 includes an aperture 446 (shown in FIG. 4B) that aligns with a corresponding aperture 450 formed in the exterior bottom surface 430 of the base 102 (shown in FIG. 4B), and a fastener, such as a screw, secures the pneumatic trip 440 to the base 102. Likewise, the spacer 442 includes an aperture 448 (shown in FIG. 4B) that aligns with a corresponding aperture 452 formed in the exterior bottom surface 430 of the base 102 to receive a fastener that secures the spacer 442 to the base 102. The fasteners through the apertures 446, 450 and the apertures 448, 452 operate to secure the entire interrupter assembly 200 to the base 102.

Figure 3A:
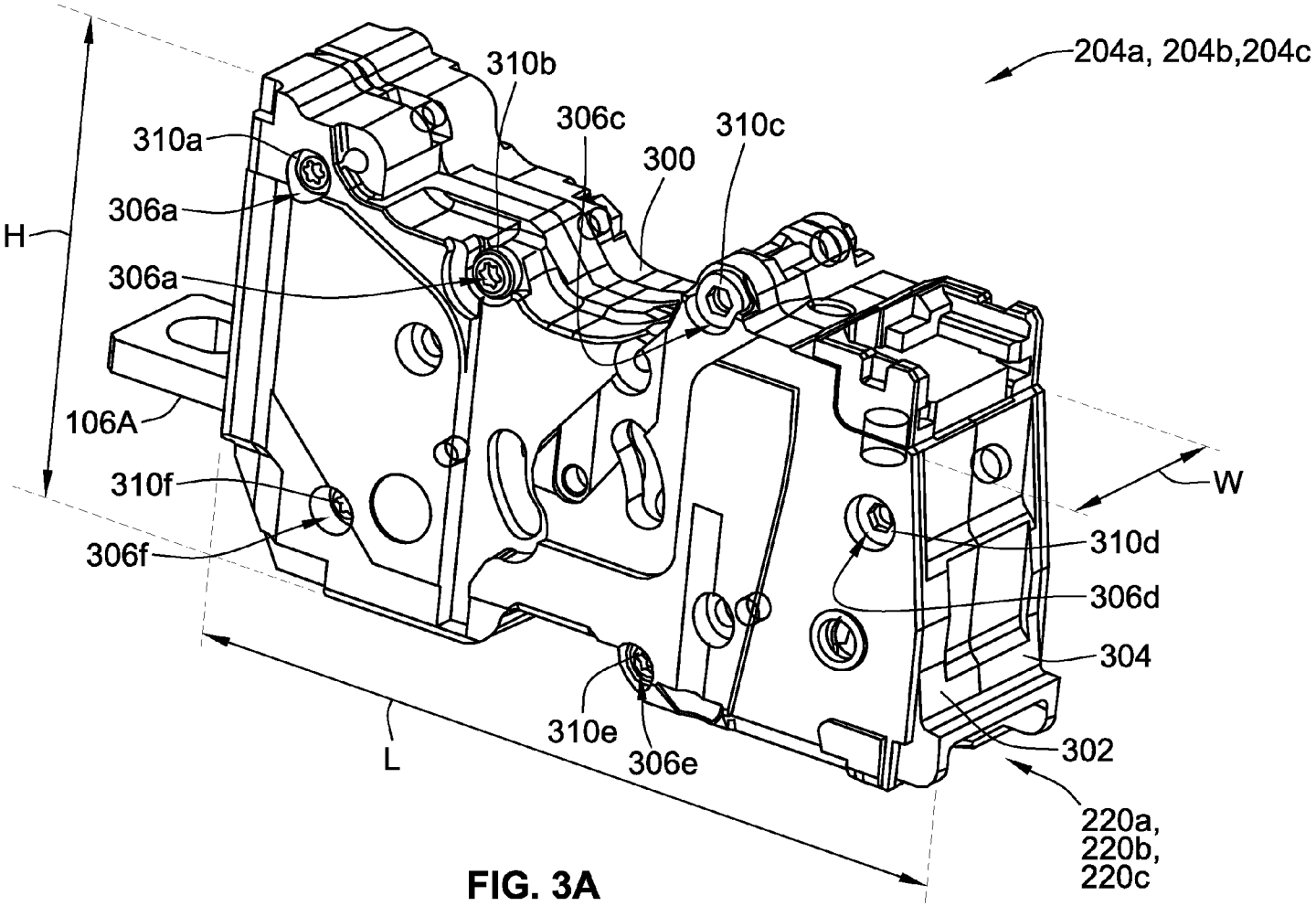
FIG. 3A illustrates a left side view of an interrupter showing six bolts installed through corresponding through-going, widthwise apertures.
Figure 3B:
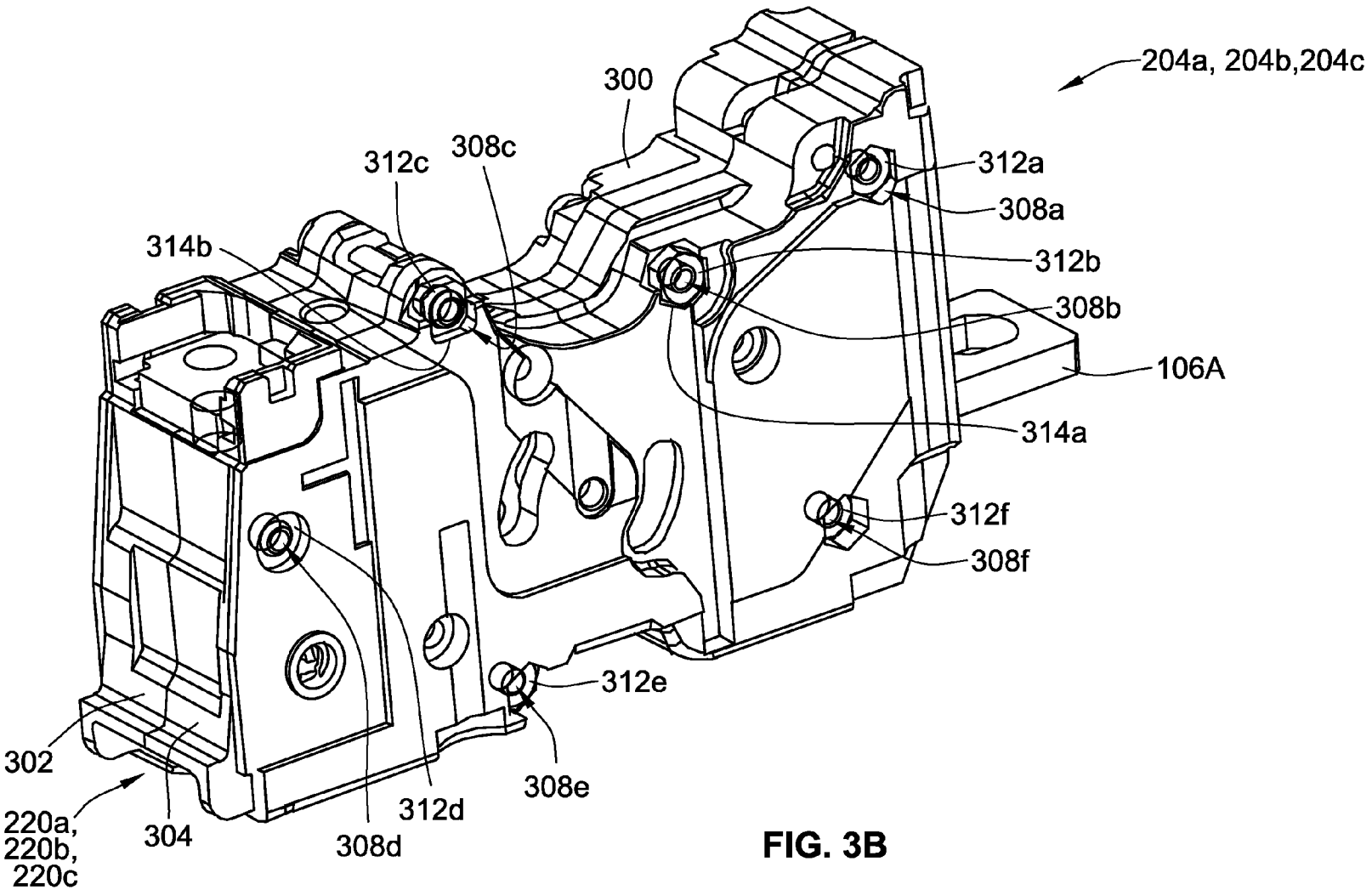
FIG. 3B illustrates a right side view of the interrupter shown in FIG. 3B showing six nuts securing the six bolts shown in FIG. 3A to secure the two pieces of the interrupter housing together.
Figure 3C:
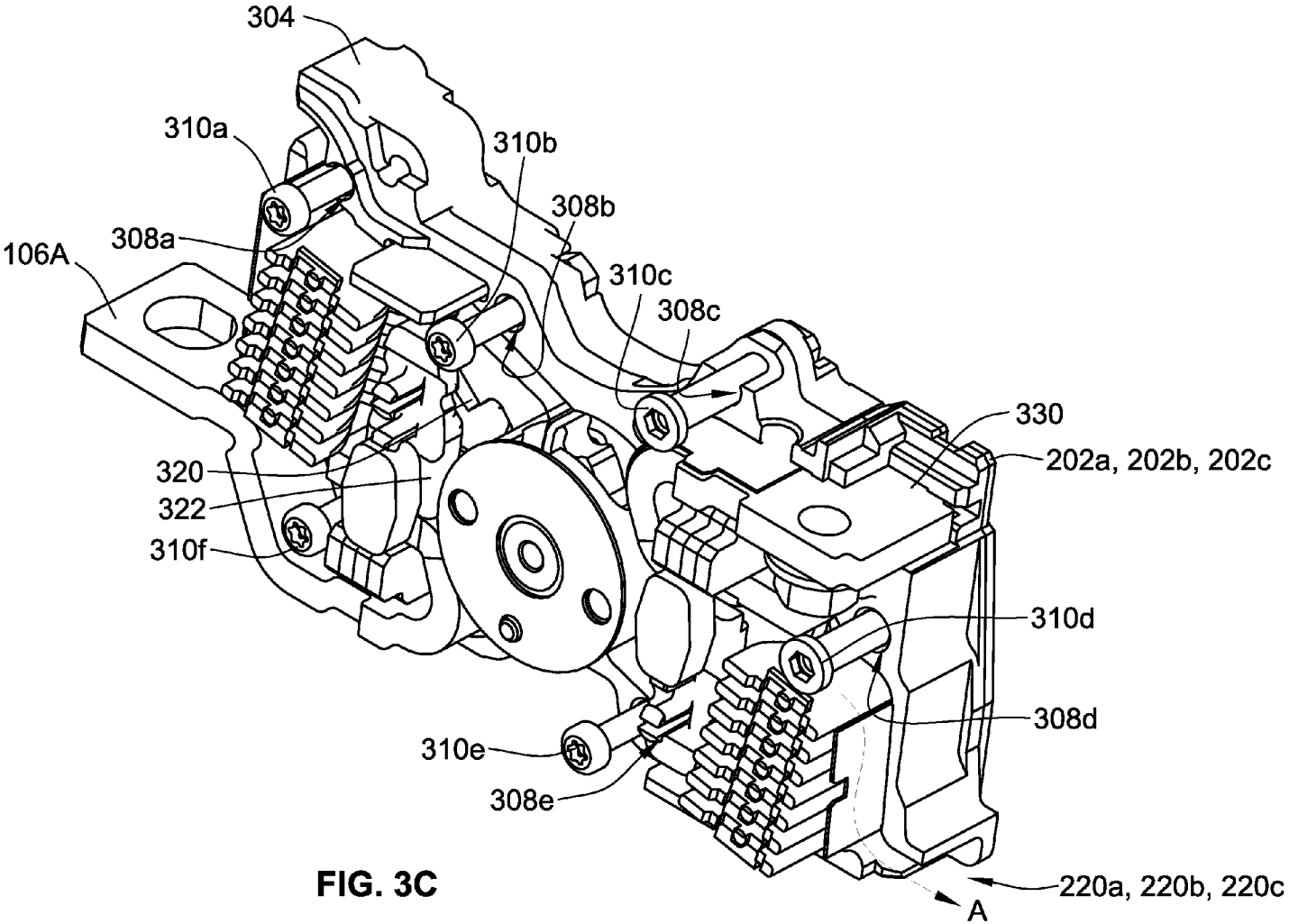
FIG. 3C illustrates the same view of the interrupter shown in FIG. 3A, except that one of the two pieces of the housing has been removed to reveal the inner components housed within the housing of the interrupter.

FIG. 3A is a perspective illustration of a first side of one of the interrupters 202, 204, 206 shown in FIGS. 1 and 2. Although one interrupter is shown, it should be understood that the description of one interrupter applies equally to the other two. The interrupter 202, 204, 206 has a housing 300 that is formed of two pieces 302, 304 that are joined along their lengthwise (L) surfaces together to form the housing 300. At least one of the pieces 302, 304 is formed using a compression molded thermoset sheet molding compound (SMC). Optionally, the two pieces 302, 304 are mirror-images of one another. The two pieces 302, 304 can be referred to herein for ease of discussion as case halves, though the use of the term "halves" is not intended to imply that the cases are precisely half the total size of the housing 300. The first piece 302 includes six apertures 306*a,b,c,d,e,f*, which are shown in FIG. 3A as having bolts 310*a,b,c,d,e,f* inserted therethrough, and the second piece 304 (shown in FIG. 3B) includes a corresponding set of six apertures 308*a,b,c,d,e,f* (shown in FIGS. 3B and 3C as having bolts 310*a,b,c,d,e,f* inserted therethrough) such that when the two pieces 302, 304 are abutted along their respective lengthwise surfaces, the two sets of apertures 306, 308 co-align to form a set of apertures 306, 308 that extend through a width, W, of the interrupter housing 300 formed by the two pieces 302, 304. The set of six bolts 310*a,b,c,d,e,f* are fastened to a corresponding set of six nuts 312*a,b,c,d,e,f* through the apertures 308, 310 in the interrupter housing 300 to secure the two pieces 302, 304 together. The heads of the bolts 310 and the nuts 312 sit flush or slightly recessed relative to an exterior major surface of the respective pieces 302, 304 so that no part of the bolts 310 or the nuts 312 extend beyond the exterior major surface of the pieces 302, 304.

The bolts 310*a-f* are high-strength bolts and one, some, or all of the bolts 310 can be hollow to allow gas to escape through the bolts between adjacent interrupters 202*a,b,c*. Each of the high-strength bolts has a property class strength rating of at least 10.9 as rated by the International Organization for Standardization (ISO). The bolt threads can be patch-locked with a fused nylon patch, for example, to create an irreversible fastening between the bolts 310 and the nuts 312. As opposed to rivets, the bolts 310 allow for much greater preload control in which the assembler can control the torque in a way that is repeatable and quantifiable. This allows the interrupter housing 300 to be designed akin to a pressure vessel, in which the torque is carefully controlled to achieve the proper clamping force between the two pieces 302, 304 while also preventing them from separating during an electrical fault due to pressure buildup inside the housing 300. Controlled bolt preload avoids under- or over-tightening of the two pieces 302, 304 together to form the housing 300, and further use less space compared to self-tapping screws or rivets. Because the heads and nuts can be recessed into the molded housing or at least sit flush relative to a major surface of the molded housing 300, there is no weight or space penalty associated with using bolts and nuts.

Optionally, some or all of the nuts 312 can be received in corresponding detented channels. For convenience, two detented channels 314*a,b* are described because they can be best seen in FIG. 3B, but it should be understood that other nuts or all of the nuts 312 can be received in detented channels like the detented channels 314*a,b*. A portion of the detented channel 314*a* has a hexagonal shape to receive therein a hexagonal-shaped nut 312*b*. Three sides of the hexagonal-shaped nut 312*b* are held in a secure relationship within the detented channel 314*a* so that while the bolt 310*b* is being fastened to the nut 312*b*, the nut 312*b* remains in place in the detented channel 314*a*, and the bolt 310*b* can be torqued to specifications. Likewise, a portion of the detented channel 314*b* has a square shape to receive therein a generally square-shaped nut 312*c*. The generally square-shaped nut 312*c* can have tapered or rounded corners as shown. One full side of the square-shaped nut 312*c* and portions of two other sides of the square-shaped nut 312*c* are held in a secure relationship within the square-shaped detented channel 314*b* so that while the bolt 310*c* is being fastened to the nut 312*c*, the nut 312*c* remains in place in the detented channel 314*b*, and the bolt 310*c* can be torqued to specifications. Of course, the nuts and detented channels can take any other geometric shape as square and hexagonal are simply two examples of many possible shapes.

FIG. 3C is a perspective illustration of the same view shown in FIG. 3A except that the first piece 302 has been removed to reveal the inner components housed within the housing 300 of the interrupter 202*a,b,c*. The bolts 310*a-f* are shown inserted through the apertures 308*a-e* (the aperture 308*f* is not visible in this view). The path indicated by arrow A shows the flow of interruption gasses and pollution produced inside the interruption housing 300 and how they exit through the exhaust outlet 220*a,b,c* of the interrupter 202*a,b,c*.

Figure 4B:
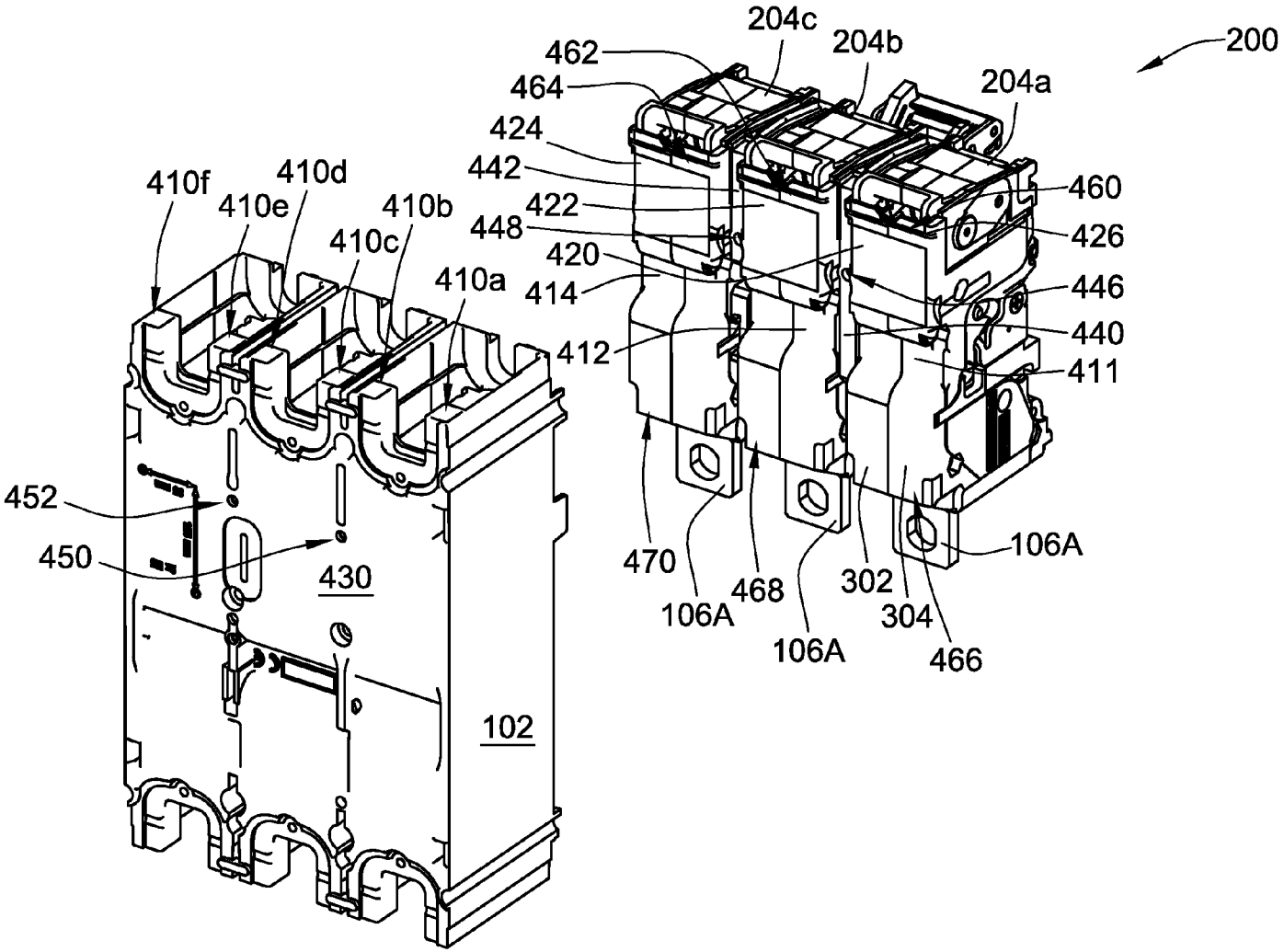
FIG. 4B is a bottom perspective, exploded view of the interrupter assembly and the base shown in FIG. 4A to show example placement of adhesive on the bottom surfaces of the interrupter shown in FIGS. 3A-3B.

FIG. 4A shows the bottom (interior) surface 402 of the base 102 with the interrupter assembly 200 exploded away from the bottom surface 402. Other components, such as the trip unit 112, the covers 110, 116, and the handle 108, are not shown for ease of illustration. FIG. 4B is a bottom view of the interrupter assembly 200 shown in FIG. 4A before it is installed into the base 102. An exterior bottom 430 of the base 102 is shown, along with bottom surfaces 411, 412, 414 of the interrupters 204*a,b,c*, respectively. An adhesive 420, 422, 424 is provided between the bottom surface 411, 412, 414 of each of the interrupters 202, 204, 206, and the bottom interior surface 402 of the housing or base 102 of the circuit breaker 100. The adhesive 420, 422, 424 is applied to bottom surface 411, 412, 414 proximate a first end 460, 462, 464 of the housing 300 out of which the exhaust outlet 220*a,b,c* exits and distal from an opposite end 466, 468, 470 out of which the line terminal 106A extends. The adhesive has selected characteristics (further described below) and is applied to extend across the two pieces 302, 304 to anchor the two pieces 302, 304 to an interior surface 402 of the base 102, to prevent the interrupter 202*a,b,c* from being lifted away from the base 102 responsive to an electrical fault, and to prevent the two pieces 302, 304 from separating away from one another responsive to the electrical fault. Once the adhesive 420, 422, 424 has been provided, the interrupter assembly 200 is installed into the base 102 such that the adhesive 420, 422, 424 adheres the bottom surfaces 411, 412, 414 of the respective interrupters 204*a,b,c* to the interior surface 402 of the housing 102 of the circuit breaker 100.

As can be seen in FIG. 4B, the base 102 includes exhaust ports 410*a-f*, a pair for each interrupter 202*a,b,c*, and each pair of the exhaust ports 410 is coupled to a corresponding exhaust outlet 220*a,b,c* of the interrupter 202*a,b,c* when installed on the base 102 such that the adhesive 420, 422, 424 forms a barrier 426 (shown on only the first interrupter 204*a* for ease of illustration) to gas and pollution produced responsive to the electrical fault such that at least substantially all of the gas and the pollution exit out the exhaust ports 410*a,b,c, d,e,f* of the base 102 and that substantially none of the gas and the pollution after exiting the exhaust outlet 220*a,b,c* enters between the bottom surface 411, 412, 414 of the interrupter 202*a,b,c* and the interior surface 402 of the base 102. Without the adhesive 420, 422, 424, a narrow gap exists between the interrupter housing 300 and the interior surface 402 of the base 102 such that interruption gasses and pollution exiting the exhaust outlet 220*a,b,c* can escape into this narrow gap, producing a pressure force that lifts the interrupter assembly 200 away from the base 102. Alternately or additionally, the exterior bottom surface 430 of the base 102 can become deformed by the pressure wave and form a bubble-like deformity because the pressure has nowhere to escape quickly once it enters that narrow gap. Worse still, a hole can be blown out of the base 102 such as out of the exterior bottom surface 430. The adhesive 420, 422, 424 plugs this narrow gap so that all or nearly all of the gasses and pollution are directed out of the exhaust outlet 220*a,b,c* and immediately into corresponding ones of the pairs of exhaust ports 410*a-b,c-d,e-f*, and eventually away from the circuit breaker 100.

The adhesive 420, 422, 424 has characteristics to anchor the two pieces 302, 304 to the interior surface 402 of the base 102, to prevent the interrupter 202*a,b,c* from being lifted away from the base 102 responsive to an electrical fault, and to prevent the two pieces 302, 304 from separating away from one another responsive to the electrical fault. These characteristics can include a maximum service temperature sufficient to retain a compliance and strength of the adhesive 420, 422, 424 during and following a short-circuit interruption of the circuit breaker 100 in the presence of electrical current at a maximum interrupting rating (such as 100 kA) of the circuit breaker 100. The maximum service temperature can be at least 90 degrees Celsius or at least 100 degrees Celsius. The characteristics can include a single component and a moisture-curing sealant that forms permanent elastic bonds. A single-component adhesive requires no mixing. When the base 102 and the housing 300 of the interrupter 202*a,b,c* are composed of dissimilar materials, another adhesive characteristic can be that it has a capability to bond dissimilar materials together. For example, if the base 102 is composed of a polycarbonate material or of a nylon material, another characteristic is a substrate adhesion sufficient to bond with the polycarbonate or nylon material of the base 102. Polycarbonate material in particular is difficult to bond to, so the adhesive 420, 422, 424 has a substrate adhesion characteristic sufficient to bond with polycarbonate.

Other characteristics include non-dripping (flow without running), moisture-cured, a relatively fast cure rate (e.g., 24-48 hours), high temperature resistance (e.g., at temperatures exceeding 90 or 100 degrees Celsius), permanently elastic with good dampening and compliance such that the adhesive does not harden and become brittle once cured, high bond strength while remaining flexible after full cure. Other characteristics can include a minimal amount of volatile organic compounds (VOC) for compliance with environmental regulations or standards. The adhesive should not chemically damage the interrupter housing 300 or the base 102 after applied. By way of example only, a suitable adhesive sharing all of these characteristics is a calcium carbonate-based sealant such as the 3M760 sealant available from the 3M Company. This adhesive is a one-component, moisture-cured adhesive, bonds dissimilar materials, is permanently elastic, has high tensile strength, and a high modulus. The tack-free time is 10-30 minutes, the rate of cure is than 3.5 mm per 24 hours, the Shore A hardness is 55, the tensile strength is 4.5 MPa, its service temperature is between −40 to 100 degrees Celsius, has a thick paste consistency, and a VOC content of 29.1 g/l. It should be emphasized that this adhesive is merely exemplary and other suitable adhesives can be used instead.

The adhesive 420, 422, 424 allows the entire structure comprised of the interrupter assembly 200, the two pieces of each interrupter 202, and the base 102 to collaborate together to resist the forces during an interruption event that want to force these pieces and parts apart from one another and to damage them. The adhesive 420, 422, 424 also has good flow characteristics that allow it to flow to fill the space proximate the exhaust ports 410 between the bottom surfaces 411, 412, 414 of the interrupter 204*a,b,c* and the interior surface 402. The adhesive 420, 422, 424 plays an important structural role in its selected characteristics and strategic placement inside the circuit breaker 100 near the exhaust ports and across both halves of the interrupter housings. The interrupting rating of the circuit breaker 100 can be at least 2-5 times higher than an interrupting rating of a non-improved circuit breaker that lacks the adhesive 420, 422, 424 disclosed herein. For example, the interrupting rating of the circuit breaker 100 is at least 100 kA at a maximum voltage (e.g., 690V), whereas the interrupting rating of the non-improved circuit breaker is 20 kA at the same maximum voltage without the adhesive 420, 422, 424, bolts 310 and nuts 312, and SMC-formed interrupter housing 300, yet both improved and non-improved circuit breakers have respective bases with the same overall physical dimensions (e.g., length and width or footprint dimensions of the base 102). In this example, the interrupting rating has increased fivefold without incurring any size or non-negligent weight penalty.

To assemble the improved circuit breaker having a service breaking capacity (interrupting rating) higher than a service breaking capacity of a non-improved circuit breaker without increasing a length or width dimension of a base of a housing of the non-improved circuit breaker, a housing or base 102 for the circuit breaker is provided. The two pieces 302, 304 are abutted along respective lengthwise surfaces to form the interrupter housing 300. The interrupter housing 300 has a first end 460, 462, 464 (FIG. 4B) out of which an exhaust outlet 220*a,b,c* releases gas produced by an electrical fault and a second end 466, 468, 470 opposite the first end 460, 462, 464 out of which the line terminal 106A extends to receive a conductor (not shown) carrying electrical current through the interrupter 202*a,b,c*. An adhesive is provided between a bottom surface 411, 412, 414 of the interrupter 202*a,b,c* proximate the first end 460, 462, 464 and distal from the opposite end 466, 468, 470. The adhesive is applied to extend across the two pieces 302, 304 that span the width W to anchor the two case halves or pieces 302, 304 to an interior surface 402 of the base 102, to prevent the interrupter assembly 200 from being lifted away from the base 102 responsive to an electrical fault, and to prevent the two case halves 302,

304 from separating away from one another responsive to the electrical fault. The interrupter 202*a,b,c* (or interrupter assembly 200) is installed into the housing or base 102 of the circuit breaker 100 such that the adhesive 420, 422, 424 adheres the bottom surface 411, 412, 414 of the interrupter 202*a,b,c* to the interior surface 402 of the housing or base 102 of the circuit breaker 100.

The two pieces 302, 304 can be formed of a compression molded thermoset sheet molding compound (SMC). The two pieces 302, 304 can be abutted along respective lengthwise surfaces thereof such that a first plurality of apertures 306 in a first of the two pieces 302 align with a second plurality of apertures 308 in a second of the two pieces 304 to form a set of apertures 306, 308 extending through a width W of the interrupter housing 300 formed by the two pieces 302, 304. Bolts 310 are fastened to a corresponding number of nuts 312 through the set of apertures 306, 308 in the interrupter housing 300 to secure the two pieces 302, 304 together.

While particular aspects and applications of the present disclosure have been illustrated and described, it is to be understood that the present disclosure is not limited to the precise construction and compositions disclosed herein and that various modifications, changes, and variations may be apparent from the foregoing descriptions without departing from the spirit and scope of the present disclosure as defined in the appended claims.

What is claimed is:

1. A circuit breaker, comprising:

a housing having a base configured to receive thereon an interrupter assembly;

an interrupter assembly including a first interrupter having a housing formed of two pieces, the first interrupter including a first electrical contact movable relative to a second electrical contact such that physical engagement of the first electrical contact with the second electrical contact permits electrical current to flow through the first interrupter and physical separation of the first electrical contact relative to the second electrical contact prevents the electrical current from flowing through the first interrupter, the first interrupter including an exhaust outlet exiting an end of the housing and a line terminal extending out of an opposite end of the housing; and an adhesive applied to a bottom surface of the first interrupter proximate the end of the housing out of which the exhaust outlet exits and distal from the opposite end out of which the line terminal extends, the adhesive being applied to extend across the two pieces to anchor the two pieces to an interior surface of the base, to prevent the first interrupter from being lifted away from the base responsive to an electrical fault, and to prevent the two pieces from separating away from one another responsive to the electrical fault.

2. The circuit breaker of claim 1, wherein the adhesive has characteristics including a maximum service temperature sufficient to retain a compliance and strength of the adhesive during and following a short-circuit interruption of the circuit breaker in the presence of electrical current at a maximum interrupting rating of the circuit breaker.

3. The circuit breaker of claim 2, wherein the maximum service temperature is at least 90 degrees Celsius.

4. The circuit breaker of claim 2, wherein the characteristics of the adhesive further include a single component and a moisture-curing sealant that forms permanent elastic bonds.

5. The circuit breaker of claim 4, wherein the base is composed of a polycarbonate material, and the characteristics further include a substrate adhesion sufficient to bond with the polycarbonate material.

6. The circuit breaker of claim 4, wherein the housing of the first interrupter is composed of a material that is dissimilar from a material of which the base is composed, the characteristics further include a capability to bond dissimilar materials together.

7. The circuit breaker of claim 1, wherein the base further includes a plurality of exhaust ports coupled to the exhaust outlet of the first interrupter when the first interrupter is installed on the base such that the adhesive forms a barrier to gas and pollution produced responsive to the electrical fault such that at least substantially all of the gas and the pollution exit out the exhaust ports of the base and that substantially none of the gas and the pollution after exiting the exhaust outlet enters between the bottom surface of the first interrupter and the interior surface of the base.

8. The circuit breaker of claim 1, wherein the two pieces are formed using a compression molded thermoset sheet molding compound (SMC), the circuit breaker further including a cover that covers the housing and a cover clip that fastens the housing of the first interrupter to the cover to resist bending or lifting of the cover during a short-circuit interruption of the circuit breaker.

9. The circuit breaker of claim 1, wherein each of the two pieces includes a set of apertures that when the two pieces are abutted against one another, the corresponding sets of apertures align to extend through a width of the interrupter housing formed by the two pieces, the circuit breaker further comprising a set of high-strength bolts inserted through the sets of apertures and fastened by a corresponding set of nuts to secure the two pieces together.

10. The circuit breaker of claim 9, wherein each of the high-strength bolts has a property class strength rating of at least 10.9 as rated by the International Organization for Standardization (ISO).

11. The circuit breaker of claim 9, a first of the two pieces includes a plurality of detented channels each configured to secure the corresponding nuts in a non-rotational relationship relative to a second of the two pieces as the respective hollow bolts are fastened to each of the nuts received in the respective detented channels.

12. The circuit breaker of claim 11, wherein at least one of the nuts is recessed relative to an exterior major surface of the first of the two pieces so that no part of the at least one of the nuts extends beyond the exterior major surface of the first piece.

13. The circuit breaker of claim 11, wherein at least one of the bolts is recessed relative to an exterior major surface of the second of the two pieces so that no part of the at least one of the bolts extends beyond the exterior major surface of the second piece.

14. The circuit breaker of claim 1, wherein an interrupting rating of the circuit breaker is at least twice an interrupting rating of a non-improved circuit breaker that lacks the adhesive.

15. The circuit breaker of claim 14, wherein the interrupting rating of the circuit breaker is at least four times higher than the interrupting rating of the non-improved circuit breaker.

16. The circuit breaker of claim 15, wherein the interrupting rating of the circuit breaker is at least 100 kA at a maximum voltage and the interrupting rating of the non-improved circuit breaker is 20 kA at the maximum voltage, and wherein a respective base of a housing of the circuit breaker and the non-improved circuit breaker has the same width and length dimensions.

17. A method of assembling an improved circuit breaker to have a service breaking capacity higher than a service breaking capacity of a non-improved circuit breaker without increasing any dimension of a base of a housing of the non-improved circuit breaker, the method comprising:

providing a housing for the circuit breaker;

abutting two pieces of an interrupter housing of an interrupter along respective lengthwise surfaces of the two pieces to form the interrupter housing, the interrupter housing having a first end out of which an exhaust outlet releases gas produced by an electrical fault and a second end opposite the first end out of which a line terminal extends to receive a conductor carrying electrical current through the interrupter;

providing an adhesive between a bottom surface of the first interrupter proximate the end of the housing out of which the exhaust outlet exits, the providing including applying the adhesive to extend across the two pieces to anchor the two pieces to an interior surface of the base, to prevent the first interrupter from being lifted away from the base responsive to an electrical fault, and to prevent the two pieces from separating away from one another responsive to the electrical fault; and installing the first interrupter into the housing of the circuit breaker such that the adhesive adheres the bottom surface of the first interrupter to the interior surface of the housing of the circuit breaker.

18. The method of claim 17, further comprising forming the two pieces using a compression molded thermoset sheet molding compound (SMC), wherein the first interrupter includes a first electrical contact movable relative to a second electrical contact such that physical engagement of the first electrical contact with the second electrical contact permits electrical current to flow through the first interrupter and physical separation of the first electrical contact relative to the second electrical contact prevents the electrical current from flowing through the first interrupter.

19. The method of claim 18, further comprising:

abutting the two pieces along respective lengthwise surfaces thereof such that a first plurality of apertures in a first of the two pieces align with a second plurality of apertures in a second of the two pieces to form a set of apertures extending through a width of the interrupter housing formed by the two pieces; and fastening a plurality of bolts to a corresponding plurality of nuts through the set of apertures in the interrupter housing to secure the two pieces together.

20. The method of claim 17, further comprising fastening a cover clip between the interrupter housing and a mechanism cover secured to a base of the housing of the circuit breaker.

* * * * *